US011549755B2

(12) United States Patent
Makepeace et al.

(10) Patent No.: US 11,549,755 B2
(45) Date of Patent: Jan. 10, 2023

(54) STIRRING OF MOLTEN METALS IN COMPLEX STRUCTURES

(71) Applicant: Altek Europe Ltd., Chesterfield (GB)

(72) Inventors: Stephen Makepeace, Chesterfield (GB); Alan Peel, Chesterfield (GB); Isaac Sewell, Chesterfield (GB)

(73) Assignee: ALTEK EUROPE LIMITED, Chesterfield (GB)

( * ) Notice: Subject to any disclaimer, the term of this patent is extended or adjusted under 35 U.S.C. 154(b) by 618 days.

(21) Appl. No.: 16/462,032

(22) PCT Filed: Nov. 27, 2017

(86) PCT No.: PCT/GB2017/053563

§ 371 (c)(1),
(2) Date: May 17, 2019

(87) PCT Pub. No.: WO2018/096367

PCT Pub. Date: May 31, 2018

(65) Prior Publication Data

US 2019/0301805 A1 Oct. 3, 2019

(30) Foreign Application Priority Data

Nov. 26, 2016 (GB) ..... 1620027

(51) Int. Cl.
*F27D 27/00* (2010.01)
*B01F 13/08* (2006.01)
(Continued)

(52) U.S. Cl.
CPC ..... *F27D 27/00* (2013.01); *B01F 33/451* (2022.01); *B22D 1/00* (2013.01); *B22D 27/02* (2013.01); *B01F 2101/45* (2022.01)

(58) Field of Classification Search
CPC ..... B01F 13/0809; B01F 2215/0075; B22D 1/00; B22D 27/02; F27D 27/00
(Continued)

(56) References Cited

U.S. PATENT DOCUMENTS 2,875,261 A * 2/1959 Hanff ..... H05B 6/34 373/146
2,963,758 A * 12/1960 Pestel et al. ..... B22D 27/02 164/5
(Continued)

FOREIGN PATENT DOCUMENTS

DE 3608711 A1 10/1986
EP 0317790 A1 5/1989
(Continued)

OTHER PUBLICATIONS

International Search Report and Written Opinion from counterpart International Patent Application No. PCT/GB2017/053563 dated Apr. 9, 2018, 13 pages.

*Primary Examiner* — Jessee R Roe
*Assistant Examiner* — Michael Aboagye
(74) *Attorney, Agent, or Firm* — Norton Rose Fulbright US LLP

(57) ABSTRACT

Apparatus and methods for stirring a molten metal are provided. The apparatus comprising: two or more discrete units, each unit including a core being provided with two or more teeth, the core being provided with at least one electrically conducting coils; in use, mounting a first discrete unit in proximity to the container at a first location; in use, mounting a second discrete unit in proximity to the container at a second location; electrical connections between the two or more discrete units and a common control unit, thereby providing an electromagnetic stirrer. The apparatus format allows the discrete units to be position between different
(Continued)

pairs of elements or parts of furnaces and the like to allow retrofitting of electromagnetic stirring where access is restricted.

17 Claims, 1 Drawing Sheet

(51) Int. Cl.

| | |
|---|---|
| ***B22D 1/00*** | (2006.01) |
| ***B22D 27/02*** | (2006.01) |
| ***B01F 33/451*** | (2022.01) |
| *B01F 101/45* | (2022.01) |

(58) Field of Classification Search
USPC ..... 373/85, 146; 266/44, 233, 234, 237
See application file for complete search history.

(56) References Cited

U.S. PATENT DOCUMENTS

| | | | | | |
|---|---|---|---|---|---|
| 2,964,581 | A * | 12/1960 | Hanff | H05B 6/34 | 373/146 |
| 4,016,926 | A * | 4/1977 | Yamada | B22D 11/122 | 164/504 |
| 4,867,786 | A | 9/1989 | Saeki et al. | | |
| 6,938,674 | B2 * | 9/2005 | Eriksson | B22D 11/115 | 164/466 |
| 8,876,934 | B2 * | 11/2014 | Eriksson | C21C 7/00 | 266/233 |
| 9,901,978 | B2 * | 2/2018 | Pavlov | H05B 6/367 | |
| 10,207,318 | B2 * | 2/2019 | Lehman | B22D 11/04 | |

FOREIGN PATENT DOCUMENTS

| | | | | |
|---|---|---|---|---|
| GB | 699156 | A | 10/1953 | |
| GB | 836356 | A | 6/1960 | |
| GB | 1109753 | * | 10/1965 | F27D 27/00 |
| JP | S62 207543 | A | 11/1987 | |
| WO | 2009117803 | A1 | 10/2009 | |
| WO | 2015125624 | A1 | 8/2015 | |

* cited by examiner

STIRRING OF MOLTEN METALS IN COMPLEX STRUCTURES

BACKGROUND OF THE INVENTION

The present invention concerns improvements in and relating to electromagnetic stirring of molten metals, particularly apparatus for stirring and methods of stirring, particularly when applied to complex existing structures.

It is known to use electromagnets to generate moving magnetic fields within molten metal and as a consequence generate motion within the molten metal. The movement causes stirring of the molten metal within its container, with beneficial effects on heat transfer, material dispersion and the like.

In general, planar electromagnetic stirrers are deployed close to a planar wall of the container in which the molten metal is to be stirrer.

Whilst planar walls for containers are commonplace, there are situations in which such planar walls are not present or are not readily accessible for deployment of an electromagnetic stirrer.

BRIEF SUMMARY OF THE INVENTION

The present invention has amongst its potential aims to provide apparatus for stirring and methods of stirring which are more optimised for deployment relative to non-planar walls of containers, particularly larger containers, most particularly with complex profiles or structures. The present invention has amongst its potential aims to provide apparatus for stirring and methods of stirring which provide better stirring effects within furnaces or other containers with external structures on or associated with one or more walls of the container. The present invention has amongst its potential aims to provide apparatus for stirring and methods of stirring which provides a stronger magnetic field and/or optimised magnetic field configuration within molten metal.

According to a first aspect of the invention there is provided apparatus for stirring a molten metal, the apparatus comprising:

two or more discrete units, each unit including a core, preferably the core being provided with two or more teeth, the core being provided with at least one electrically conducting coils;

preferably, in use mounting a first discrete unit in proximity to the container at a first location;

preferably, in use mounting a second discrete unit in proximity to the container at a second location;

electrical connections between the two or more discrete units and a common control unit, thereby providing an electromagnetic stirrer.

In a preferred form to the first aspect of the invention, the two or more teeth may have an end proximal the core and an end distal the core, the end distal the core may define a tooth end face, the tooth end face for at least one of the teeth may not being aligned with the tooth end face for at least one of the other teeth.

According to a second aspect of the invention there is provided a method of stirring molten metal within a container, the method including:

providing two or more discrete units, each unit including a core, preferably the core being provided with two or more teeth, the core being provided with at least one electrically conducting coils;

mounting a first discrete unit in proximity to the container at a first location; mounting a second discrete unit in proximity to the container at a second location;

electrically connecting the two or more discrete units to a common control unit, thereby providing an electromagnetic stirrer, the common control unit applying a current to at least one of the electrically conducting coils at a first time to generate a first magnetic field configuration;

the common control unit applying a current to at least one of the other electrically conducting coils at a second time to generate a second magnetic field configuration, such that the changes in magnetic field configuration cause movement of the molten metal within the container;

wherein the first location and the second location are different, wherein a part of the container or an element connected to the container is interposed between the first location and the second location.

In a preferred form to the second aspect of the invention, the two or more teeth may have an end proximal the core and an end distal the core, the end distal the core may define a tooth end face with a tooth edge around that tooth end face, a tooth end face plane may be defined as the plane passing through three points on the tooth edge of the tooth end face, the tooth end face plane for at least one of the teeth may not be aligned with the tooth end face plane for at least one of the other teeth.

The first and second aspects of the invention may include any of the following features, options and possibilities.

The first location and the second location may be different in terms of being spaced relative to one another. The first location and the second location may be different in terms of being between different pairs of elements or parts. The first location and the second location may be different in terms of being in different gaps between elements or parts. The first location and second location may be different in terms of being space along a wall or along the perimeter of the container.

The interposed part or element may be interposed in terms of obscuring and/or intersecting a direct line from at least a part the first discrete unit to at least a part of the second discrete unit. The interposed part or element may be interposed in terms of obscuring and/or intersecting a direct line from the centre of the first discrete unit to the centre of the second discrete unit. The interposed part or element may be interposed in terms of obscuring and/or intersecting a direct line from any part of the first discrete unit to any part of the second discrete unit.

The part may be one or more of: a projection; a profile; an element; a plate; particularly when an integral part of the container.

The element may be one or more of: a stay; a support; a projection; a framework; a structural element; particularly when connected to or contacting the container.

A third discrete unit may be provided, preferably at a third location. The third location may different from the other locations in the same or a different manner to the difference between the first location and the second locations, particularly as defined above.

A fourth or more discrete unit may be provided, preferably at fourth or more locations. The fourth or more locations may different from the other locations in the same or a different manner to the difference between the first location and the second locations, particularly as defined above.

A discrete unit may be placed I each of a series of gaps, particularly a sequential set of gaps.

The phasing of the discrete units may be controlled to determine the magnetic force generated.

One or more or all of the electrical conducting coils may be provided on their own core or own tooth. One or more or all of the electrically conducting coils may be interleaved with one or more other coils, for instance on the same tooth and/or on adjoining teeth. The adjoining teeth may be within the same discrete unit and/or may be in an adjacent discrete unit.

The core may include a base connector upon which one or more or all of the teeth are provided. The core may include a base connector which connects one or more of the teeth together. The core may provide a magnetic circuit between one tooth and one or more other teeth. The base connector may have a face from which the one or more teeth extend. The base connector may have a face opposing the face from which the teeth extend. One or both faces may be planar.

The tooth end face for at least one of the teeth may be considered not aligned with the tooth end face for at least one of the other teeth when one or more or all of the following apply:

1) One or more tooth end faces are inclined at an angle relative to one or more another tooth end faces;
2) One or more tooth end faces are inclined at an angle relative to a face of the base connector which connects two or more of the teeth together;
3) One or more tooth end faces are inclined at an angle relative to one or more another tooth end faces and one or more tooth end faces are parallel to a face of the base connector which connects two or more of the teeth together;
4) One or more tooth end faces are parallel to, but not coplanar with one or more another tooth end faces;
5) One or more tooth faces are parallel to, but not coplanar with one or more another tooth end faces and are parallel to, but not coplanar with a face of the base connector.

One or more or each of the tooth end faces may have a tooth edge around that tooth end face. The tooth edge may be defined by the boundary between the tooth end face and the side surface or surfaces of the tooth. A tooth end face plane may be defined for one or more of the tooth end faces. The tooth end plane may be defined as a plane passing through three points on the tooth edge of the tooth end face.

The tooth end face for at least one of the teeth may be considered not aligned with the tooth end face for at least one of the other teeth when the tooth end face plane for at least one of the teeth is not aligned with the tooth end face place for at least one of the other teeth. The tooth end faces may be considered not to be aligned when one or more or all of the following apply:

1) One or more tooth end face planes are inclined at an angle relative to one or more another tooth end face planes;
2) One or more tooth end face planes are inclined at an angle relative to a face of the base connector which connects two or more of the teeth together;
3) One or more tooth end face planes are inclined at an angle relative to one or more another tooth end face planes and one or more tooth end faces are parallel to a face of the base connector which connects two or more of the teeth together;
4) One or more tooth end face planes are parallel to, but not coplanar with one or more another tooth end face planes;
5) One or more tooth end face planes are parallel to, but not coplanar with one or more another tooth end face planes and are parallel to, but not coplanar with a face of the base connector;
6) One or more of the tooth end faces is non-planar, but one or more of criteria 1 to 5 in this list apply.

One or more or all of the teeth may extend perpendicular to the base connection. Each tooth may have an extent away from the base connection. One or more of the teeth may have a greater extent that one or more of the other teeth. The tooth end face or a part thereof may represent the maximum extent of the tooth away from the base connection.

The outermost tooth on one side of the set of teeth, preferably the outermost tooth on both sides of the set of teeth, may be have a greater extent and/or be longer than one or more and preferably all of the other teeth. Preferably the extent and/or length of the outermost teeth is the same. The inner most tooth for an odd number of teeth and the innermost pair of teeth for an even number of teeth may have a lesser extent and/or be shorter than one or more or preferably all of the other teeth. Teeth intermediate the outermost and the innermost teeth or pair of teeth may have an intermediate extent and/or length.

Where four teeth are provided, then outermost tooth on both sides of the set of teeth may have a greater extent and/or be longer than one or both inner teeth. Preferably the extent and/or length of the outermost teeth is the same. The inner pair of teeth may have a lesser extent and/or be shorter than one or both outer teeth. Preferably the extent and/or length of the innermost pair of teeth is the same.

Where three teeth are provided, then outermost tooth on both sides of the set of teeth may have a greater extent and/or be longer than innermost tooth. Preferably the extent and/or length of the outermost teeth is the same. The innermost tooth may have a lesser extent and/or be shorter than one or both outer teeth.

Where two teeth are provided preferably the outermost portion of the tooth end face has a greater extent and/or is longer than one or more and preferably all of the other portions of the tooth end face, particularly the innermost portion of the tooth end face. The innermost portion of the tooth end face may have a lesser extent and/or be shorter than one or more or preferably all of the other portions of the tooth end face.

One or more or all of the tooth end faces may be provided such that the air gap between the end face and the outer wall of the opposing part of the container for the molten metal is less than 10 centimeters (cm), preferably less than 5 cm, more preferably less than 4 cm, still more preferably less than 3 cm, yet more preferably less than 2 cm and ideally less than 1 cm. One or more of the tooth end faces may be inclined and/or orientated and/or profiled so as to provide all of the tooth end face within a maximum air gap value. The maximum air gap value may be less than 10 cm, preferably less than 5 cm, more preferably less than 4 cm, still more preferably less than 3 cm, yet more preferably less than 2 cm and ideally less than 1 cm.

One or more or all of the tooth end faces may be aligned with the opposing part of the container for the molten metal. A tooth end face may be so aligned when one or more or all of the following apply:

a) A location on the tooth end face for two or more and preferably all tooth end faces lies on a common arc;
b) A location on the tooth end face for two or more and preferably all tooth end faces lies on a common arc and that common arc is concentric with the arc defined by at least the opposing part of the container for the molten metal;

c) An equivalent location on the tooth end face for two or more and preferably all tooth end faces lies on a common arc;

d) An equivalent location on the tooth end face for two or more and preferably all tooth end faces lies on a common arc and that common arc is concentric with the arc defined by at least the opposing part of the container for the molten metal;

e) The centre of the tooth end face for two or more and preferably all tooth end faces lies on a common arc;

f) The centre of the tooth end face for two or more and preferably all tooth end faces lies on a common arc and that common arc is concentric with the arc defined by at least the opposing part of the container for the molten metal.

The opposing part of the container may preferably be a metal plate, such as a stainless steel plate.

The casing for the apparatus may pass through the air gap between the tooth end faces and the opposing part of the container.

The casing for the apparatus may be a metal skin or barrier to protect the apparatus from factors in the environment such as molten metal or metal.

The casing may include a container opposition section. The container opposing section of the casing may pass through the air gap between the tooth end faces and the opposing part of the container. The container opposing section may be profiled to provide a consistent separation between the section and the opposing part of the container. The consistent separation may be provided if the separation varies by less than 2 cm, more preferably less than 1 cm across different parts of the container opposing section. The container opposing section may be profiled to provide a consistent maximum separation between the section and the closest part of the tooth end faces. The consistent separation may be provided if the separation varies by less than 2 cm, more preferably less than 1 cm, ideally less than 0.5 cm across different parts of the container opposing section.

The apparatus may have an extent relative to the container, particularly an opposing part of the container. The extent may be an arc extent. The extent may be less than 20% of the perimeter of the container, preferably less than 15% of the perimeter and more preferably less than 10% of the perimeter and potentially less than 5% of the perimeter.

The measurement of the non-planar characteristics of the wall for the container for the molten metal at the location at which stirring is to be provided may be made with reference to the opposing part of the container to the apparatus and/or may include one or more of: the curvature of the wall; the variation in radial extent of the wall; the shape of the profile, for instance arc, within that part of the wall.

The first, second and third aspects of the invention may include any of the following features, options and possibilities, together with those set out in the specific description and elsewhere within the application.

The method of stirring may be a method of stirring molten metal. The method of stirring may be a method of stirring aluminium.

The method of stirring may be a method of stirring a furnace. The method of stirring may be a method of stirring a ladle, storage vessel, transport vessel, holding furnace.

The method of stirring may be a method of stirring using a side mounted stirrer.

A apparatus may further include one or more of: a casing for the apparatus; a support frame; one or more cooling spaces; a control system. The support frame may support the core and/or one or more or all of the coils of electrical conductor and/or the control system.

The support frame may support the core and/or teeth and/or electrically conducting coils and/or casing for the apparatus and/or cooling system and/or control system. The support frame preferably maintains a consistent position for the support the core and/or teeth and/or electrically conducting coils and/or casing for the apparatus during the application of and removal of current to one or more or all of the electrically conducting coils.

The one or more cooling spaces may be provided within the apparatus and be in fluid communication with a source of coolant.

The control system may control the current and/or voltage and/or timing thereof and/or duration thereof for one or more and preferably all of the electrically conductive coils. The control system may control the phases and/or phasing of activation and/or deactivation of the magnetic field and/or current to the electrically conductive coils. The control system may apply a current to at least one of the electrically conducting coils at a first time to generate a first magnetic field configuration and/or applying a current to at least one of the other electrically conducting coils at a second time to generate a second magnetic field configuration, such that the changes in magnetic field configuration cause movement of the molten metal within the container.

The core is preferably formed of a ferromagnetic material, such as iron or steel. The core preferably integrally provides the connection base and the teeth extending therefrom.

The connections preferably provide for the separate application of current to the separate electrically conducting coils. The connections preferably allow a single power supply to provide the current to the separate electrically conducting coils.

BRIEF DESCRIPTION OF THE DRAWINGS

Various embodiments of the invention will not be described, with reference to the accompanying drawings by way of example only, in which.

DETAILED DESCRIPTION OF THE INVENTION

Figure 1:
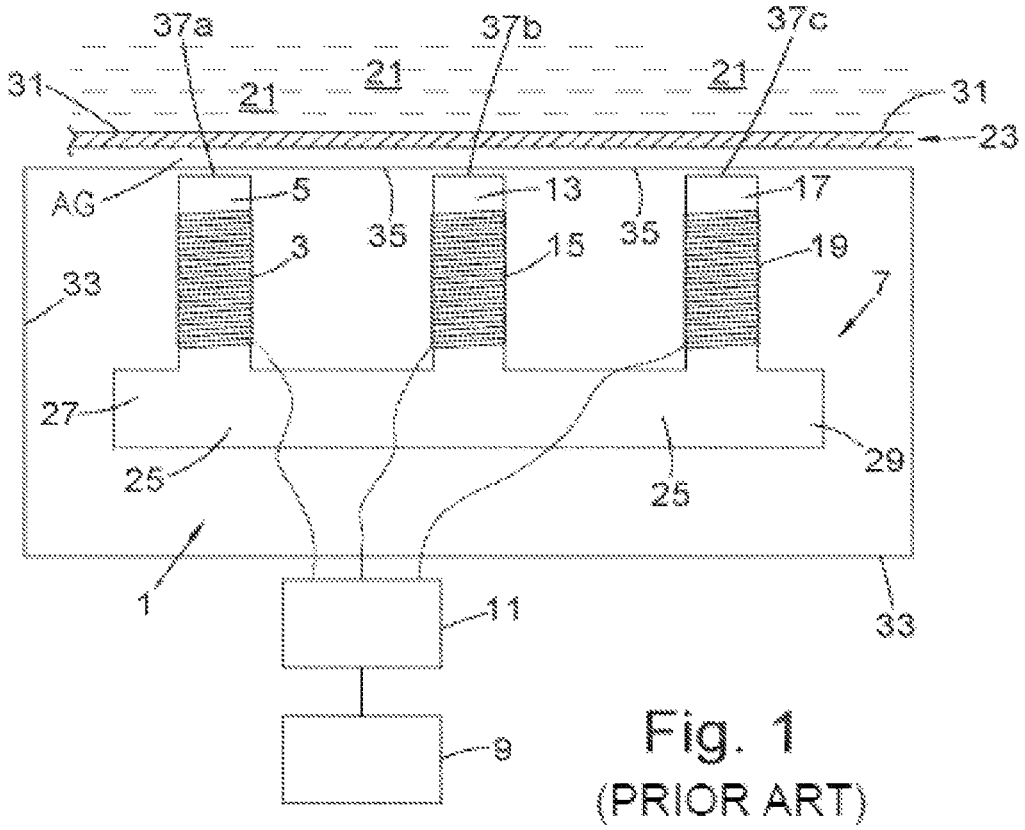
Fig. 1 (PRIOR ART)
FIG. 1 illustrates a prior art planar electromagnetic stirrer configuration.

As illustrated in FIG. 1, an electromagnetic stirrer 1 comprises a closely coiled electrical conductor 3 (e.g., coil 3) wrapped around a first tooth 5 of a core 7. In such an arrangement the tooth can be considered as a pole and the terms can be used interchangeably. The conductor 3 is connected to a power supply 9 via a control system 11. The control system 11 determines the timing, current, voltage and other operating conditions applied to the electrical conductor 3 and hence the resultant magnetic field generated by the electrical conductor 3.

The core 7 is generally of a ferromagnetic or ferromagnetic material, such as iron, and is crucial to concentrating the magnetic flux and hence the generation of a more powerful magnetic field than would be achieved without the core 7. Typically a thousand time increase in the strength of the magnetic field is possible through the use of the core 7.

The magnetic field arises which a current passes through the conductor 3 and disappears when the current is removed. This occurs quickly and so makes the use of electromagnets beneficial where a changing magnetic field is required.

As shown in FIG. 1, the second tooth 13 has a second coil 15 and the third tooth 17 has a third coil 19. The control system 11 ensures that current can be fed to the first coil 3, second coil 15 and third coil 19 at different times. The use of different phases means that the configuration of the overall magnetic field arising changes with time. Correct configuration of the operating conditions, including the phase for the coils, ensures that the resultant magnetic field serves to move molten metal 21 (for instance aluminium) within the container 23 which the electromagnetic stirrer 1 is provided for.

In the FIG. 1 embodiment, the core 7 forms a continuous mass throughout the first tooth 5, second tooth 13, third tooth 17 and the connecting base 25. The connecting base 25 links the three poles and also provides a first side extension 27 and a second side extension 29 at the two ends. As a result, the first tooth 5, second tooth 13, and third tooth 17 are effectively individual teeth extending from the connecting base 25.

In effect, the core 7 and the molten metal 21 form a magnetic circuit with relatively low reluctance. The air gap AG has a higher reluctance but is kept small by the relative deployment of the electromagnetic stirrer 1 and the container 23.

As shown, the electromagnetic stirrer 1 is provided in proximity with a planar wall 31 of the container 23. The casing 33 provided around the electromagnetic stirrer 1 has a planar wall 35 facing the planar wall 31 of the container 23. The end faces 37*a*, 37*b* and 37*c* of the three poles are also aligned in a common plane (extending left to right in the illustration) and the connecting base 25 of the core 7 also means that the connecting base 25 and the ends of the three poles distal to the planar wall 35 also occupy a separate common plane (extending left to right in the illustration).

In very many cases, the container 23 in which molten metal 21 is to be stirred features a planar wall 31, for instance as a side wall or a base wall, for the container 23 and so the planar wall 35 of the casing 33 can be placed close to the planar wall 31 of the container. This means that the total air gap AG is kept low.

Figure 2:
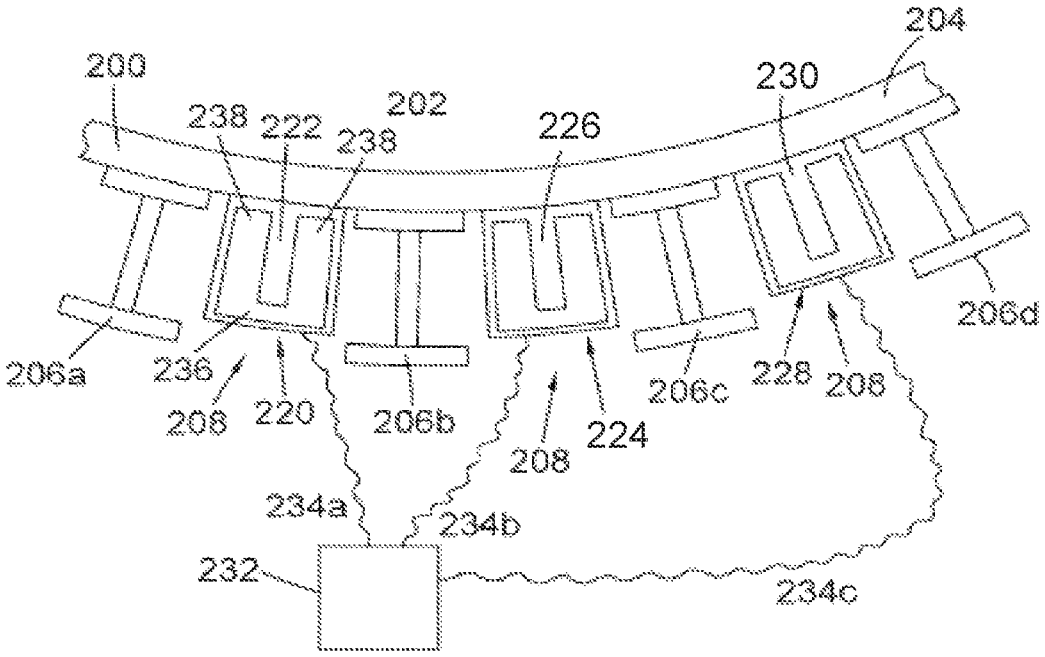
FIG. 2 illustrates in plan view a first embodiment of the present invention deployed relative to a furnace with external bracing.

As illustrated in FIG. 2, there are containers 200 which contain molten metal 202 and which require stirring, but which feature curved walls 204 and/or complex structures associated with those walls 204. In the FIG. 2 embodiment, the container 200 is a circular furnace and as such has a substantial diameter, for instance greater than 4 meters (m), and hence a substantial circumference. The overall mass and/or size of the circumference means that furnace is not moveable and that a stirrer cannot encircle the container. Curved surfaces are also encountered in rotary furnaces and other such containers for molten metal. As illustrated in FIG. 2, to support the mass of molten metal 202 within the container 200 a series of stays 206 are provided on the curved wall 204 to give sufficient structural strength.

If it is desired to conduct electromagnetic stirring on such a container 200 then there are problems for existing approaches. Firstly, the gap 208 between adjacent stays 206*a* and 206*b*, for instance, is insufficient to allow the introduction of an electromagnetic stirrer such as that illustrated in FIG. 1. Scaling down the electromagnetic stirrer to fit the gap 208 available is not a viable option due to the limited magnetic forces that could be applied to the molten metal 202 as a result. Removing one or more of the stays 206 is not a cost effective solution because of the scale of the task involved and indeed may not be possible whilst still retaining the necessary structural properties for the container 200.

FIG. 2 shows one embodiment of a solution provided according to the present invention. A first inductor 220 is provided within a first unit 222 between a first stay 206*a* and a second stay 206*b*. A second inductor 224 is provided within a second unit 226 between the second stay 206*b* and a third stay 206*c*. A third inductor 228 is provided within a third unit 230 between the third stay 206*c* and a fourth stay 206*d*.

A common controller 232 acts on the electrical connection 234*a*, 234*b*, 234*c* to the three separate units 222, 226, 230 so as to separately control the application of the electric current to each and hence the magnetic field generated.

In this embodiment, each inductor is formed of core 236 which provides a pair of teeth 238 which extend towards the container 200. The teeth 238 and the core 236 are formed of a common material offering low reluctance. The teeth 238 are each provided with an electrically conductive coil (not shown for clarity purposes).

The common controller allows the application of current to an inductor, the build-up of the magnetic field as a result and the withdrawal of the current and hence the magnetic field. The common controller also allows the sequence of these steps, the firing of the phases, to be controlled for the three separate inductors such that they work in a sequential manner to apply force to the molten metal 202 in the container 200 and hence stir the contents of the container 200.

The overall effect is similar to that from the stirrer of FIG. 1, but the effect is achieved using a series of separate inductors 220, 224, 228 mounted between the obstructions such as the stays 206.

In further embodiments, more complex arrangements for the electrically conductive coils may be provided. For instance, two or more coils may be provided on a single tooth, for one or more or all of the teeth. Those two or more coils may be interleaved. It is also possible for the electrically conductive coil of one inductor to be interleaved with an adjacent inductor. For instance, moving left to right: the first tooth of the first inductor may be provided with its own coil; the second tooth may be provided with a coil which interleaves with the first tooth of the second inductor; the second tooth of the second inductor may be provided with a coil which interleaves with the first tooth of the third inductor; the second tooth of the third inductor may be provided with its own coil. In such arrangements low reluctance material may be provided to bridge the gap between the cores/teeth for the interleaved coils.

The invention claimed is:

1. Apparatus for stirring a molten metal in a curved container having a plurality of stays, the apparatus comprising:

a first discrete unit and a second discrete unit, each unit including a core having two or more teeth and at least one electrically conducting coil;

a common controller coupled to the first discrete unit and the second discrete unit via electrical connections; and wherein the first discrete unit is configured to be coupled to a curved wall of the curved container at a first location between a first pair of the plurality of stays and the second discrete unit is configured to be coupled to the curved wall of the curved container at a second location between a second pair of the plurality of stays; and wherein a first stay is disposed between the first discrete unit and the second discrete unit, such that the first stay is intersected by a direct line extending from the first discrete unit to the second discrete unit.

2. Apparatus according to claim 1, wherein:

the two or more teeth have a first end proximal the core and a second end distal the core, the second end defines a tooth end face, and the tooth end face of a first tooth of the two or more teeth is not aligned with the tooth end face of a second tooth of the two or more teeth.

3. Apparatus according to claim 1, wherein the first stay of the plurality of stays is interposed between the first discrete unit and the second discrete unit, such that the first stay is intersected by a direct line from a centre of the first discrete unit to a centre of the second discrete unit.

4. Apparatus according to claim 1, wherein the plurality of stays extend away from an outer surface of the curved wall and comprise: a projection; a profile; an element; a plate; an integral part of the container, or combination thereof.

5. Apparatus according to claim 1, wherein the plurality of stays contact the container.

6. Apparatus according to claim 1, further comprising:

a plurality of discrete units, including the first and second discrete units; and wherein:

a respective discrete unit of the plurality of discrete units are positioned in each of a series of gaps defined by two adjacent stays of the plurality of stays positioned along the perimeter of the container.

7. Apparatus according to claim 1, wherein the common controller is configured to independently control a phasing of the discrete units to determine a magnetic force generated by the first and second discrete units.

8. Apparatus according to claim 2, wherein the tooth end face for at least one of the teeth is considered not aligned with the tooth end face for at least one of the other teeth when one of the following apply:

1) One or more tooth end faces are inclined at an angle relative to one or more another tooth end faces;
2) One or more tooth end faces are inclined at an angle relative to a face of a base connector which connects two or more of the teeth together;
3) One or more tooth end faces are inclined at an angle relative to one or more another tooth end faces and one or more tooth end faces are parallel to a face of the base connector which connects two or more of the teeth together;
4) One or more tooth end faces are parallel to, but not coplanar with one or more another tooth end faces;
5) One or more tooth faces are parallel to, but not coplanar with one or more another tooth end faces and are parallel to, but not coplanar with a face of the base connector.

9. Apparatus according to claim 1, wherein one or more or all of the teeth extend perpendicular to a base connection, each tooth having an extent away from the base connection, one or more of the teeth having a greater extent that one or more of the other teeth.

10. Apparatus according to claim 9, wherein a first outermost tooth has a greater extent than one or more of the other teeth.

11. Apparatus according to claim 10, wherein:

based on a number of teeth being an odd number, the extent of the first outermost tooth is the same as an innermost tooth; and based on a number of teeth being an even number, an innermost pair of teeth have a lesser extent than one or more of the other teeth.

12. Apparatus according to claim 11, wherein teeth intermediate the outermost tooth and the innermost tooth or pair of teeth have an intermediate extent.

13. Apparatus according to claim 2, wherein one or more or all of the tooth end faces are provided such that an air gap between the end face and an outer wall of the container is less than 10 cm.

14. Apparatus according to claim 2, wherein one or more of the tooth end faces are inclined and/or orientated and/or profiled so as to provide all of the tooth end face within a maximum air gap value, the maximum air gap value being less than 10 cm.

15. A method of stirring molten metal within a curved container, the method including:

mounting a first discrete unit on a curved wall of the curved container at a first location;

mounting a second discrete unit on the curved wall of the curved container at a second location;

applying, via a controller, a first current to one or more first electrically conducting coils of the first discrete unit at a first time to generate a first magnetic field configuration; and applying, via the controller, a second current to one or more second electrically conducting coils of the second discrete unit at a second time to generate a second magnetic field configuration, such that changes in magnetic field configuration cause movement of the molten metal within the curved container;

wherein the first location and the second location are different, and wherein a stay is interposed between the first location and the second location such that the stay is intersected by a direct line extending from the first discrete unit to the second discrete unit.

16. The method of claim 15, further comprising:

mounting a third discrete unit on the curved wall of the curved container at a third location; and applying, via a controller, a third current to one or more third electrically conducting coils of the third discrete unit at a third time to generate a third magnetic field configuration.

17. Apparatus for stirring a molten metal in a container having a plurality of stays that define a series of gaps on an outer surface of the container, the apparatus comprising:

a first discrete unit and a second discrete unit, each unit including a core having two or more teeth and at least one electrically conducting coil a common controller; and electrical connections extending between the first and second discrete units and the common controller;

wherein the first discrete unit is configured to abut the container at a first location within a first gap of the series of gaps and the second discrete unit is configured to abut the container at a second location within a second gap of the series of gaps such that at least one stay of the plurality of stays intersects a direct line extending from a first portion of the first discrete unit to a first portion of the second discrete unit;

wherein the first location and second location are different in terms of being spaced along a perimeter of the container; and wherein a stay is interposed between the first discrete unit and the second discrete unit, such that the stay intersects a direct line extending from a first portion of the first discrete unit to a first portion of the second discrete unit.

* * * * *